United States Patent [19]

Sano

[11] Patent Number: 4,691,655

[45] Date of Patent: Sep. 8, 1987

[54] MECHANISM FOR PRODUCING STITCHED PATTERNS IN A ZIGZAG SEWING MACHINE

[75] Inventor: Yasuro Sano, Hachioji, Japan

[73] Assignee: Janome Sewing Machine Co. Ltd., Tokyo, Japan

[21] Appl. No.: 818,817

[22] Filed: Jan. 14, 1986

[30] Foreign Application Priority Data

Jan. 14, 1985 [JP] Japan ..... 60-2344[U]
Jan. 21, 1985 [JP] Japan ..... 60-5459[U]

[51] Int. Cl.[4] ..... D05B 3/02; D05B 3/06
[52] U.S. Cl. ..... 112/466
[58] Field of Search ..... 112/466, 464

[56] References Cited

U.S. PATENT DOCUMENTS 2,517,079 8/1950 Birdsall ..... 112/466 X
3,792,673 2/1974 Bianchi ..... 112/466 X
4,077,341 3/1978 Kasuga ..... 112/466 X
4,428,311 1/1984 Sano ..... 112/466
4,643,120 2/1987 Hanyo et al. ..... 112/466

*Primary Examiner*—Werner H. Schroeder
*Assistant Examiner*—Andrew M. Falik
*Attorney, Agent, or Firm*—Michael J. Striker

[57] ABSTRACT

In a zigzag sewing machine, a mechanism for producing stitched patterns includes a shaft carrying a first group of pattern cams and a second group of pattern cams rotatable by a drive shaft and having different speed reduction ratios. Two followers movable by a pattern selecting dial via a pattern selecting shaft are engageable with the cams of the first and second cam group, respectively. It is possible to select patterns by a control of an actuating pawl which is carried out by operating an independently provided selecting dial. The stitched patterns of the conventional reduction ratio may be controlled without changing their size.

5 Claims, 17 Drawing Figures

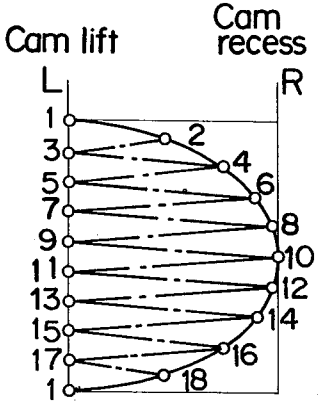
FIG_5(1)
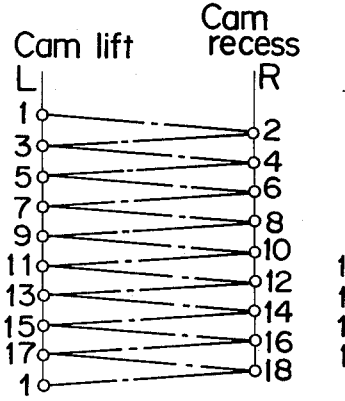
FIG_5(2)
FIG_5(3)
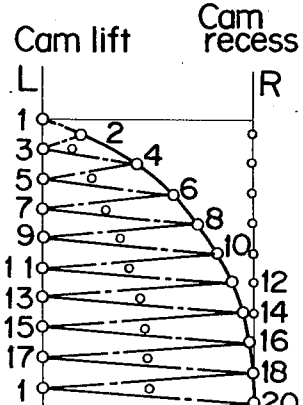
FIG_5(4)

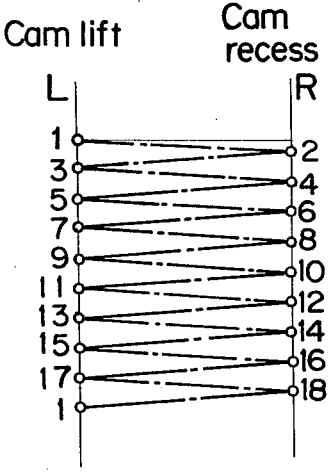
FIG_11(1)
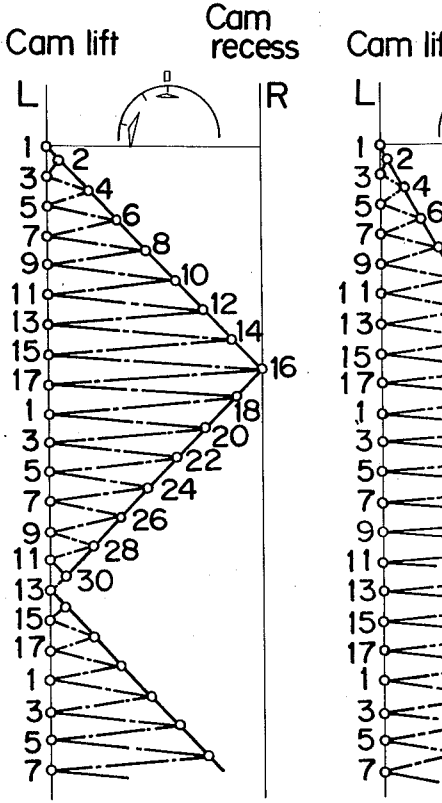
FIG_11(2)
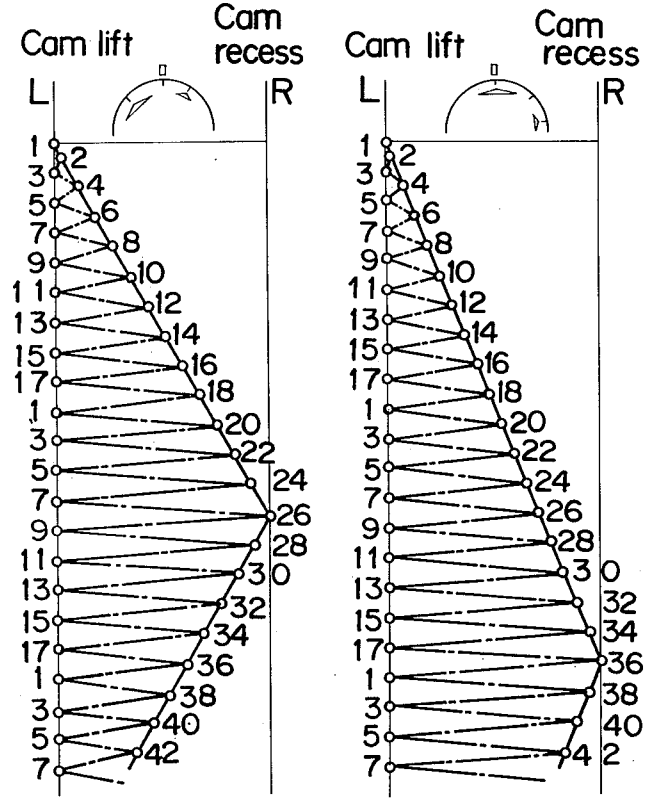
FIG_11(3)
FIG_11(4)

MECHANISM FOR PRODUCING STITCHED PATTERNS IN A ZIGZAG SEWING MACHINE

BACKGROUND OF THE INVENTION

1. Field of the Invention

This invention relates to a mechanism for producing stitched patterns in a zigzag sewing machine, and more particularly to an engaging mechanism of a plurality of followers which follow 1st and 2nd pattern cams to be rotated at different speed reduction ratios respectively.

Conventional zigzag sewing machines are in general designed with respect to sizes of machine frames, and accordingly spaces within the machine frames are limited. Therefore, pattern forming cams are selected in size, especially diameter, irrespectively of exchanging type or built-in type. In addition, cam lifts and cam pressing angles are selected so that cam followers are movable, and therefore the number of swinging movements of a needle bar during one rotation of the pattern forming cam is naturally limited, and the stitching number during one cycle of a pattern cannot be increased as desired. Therefore the cams with a maximal reduction ratio 1:18 are utilized.

It has been recently desired to stitch patterns of larger sizes such as satin stitches, scallop stitches. Speed reduction cams of ratio 1/36 are partially incorporated for producing patterns of 36 stitches in one cycle as far as scallop stitches are concerned. However, the cam lift in response to the pressure of the cam follower is limited as mentioned above, and it has been difficult to swing the needle in the full amplitude amount (e.g. 7 mm) of the zigzag sewing machine. Accordingly, patterns to be produced have been limited.

SUMMARY OF THE INVENTION

It is an object of the present invention to produce large sized patterns by swinging the needle in the full amplitude amount with respect to the patterns of 1/36 reduction ratio.

It is another object of the invention to produce large sized patterns by swinging the needle in the full amplitude amount with respect to elongated patterns where the pattern length may be changed as desired.

The objects of the invention are attained by a zigzag sewing machine which has a drive shaft rotated to vertically reciprocate, pattern cams, a needle which is operatively connected to the pattern cams and is swingable laterally of a fabric feeding direction under the control of the pattern cams. The sewing machine further comprises a cam shaft, a first group of pattern cams rotatably mounted on the cam shaft and operatively connected to the drive shaft to be rotated thereby at a first predetermined reduced speed and a second group of pattern cams rotatably mounted on the cam shaft and operatively connected to the first group of pattern cams to be rotated thereby at a second predetermined reduced speed. The sewing machine also includes transmission means including a swingable member located between the first and the second groups of pattern cams and the swingable needle and operatively connected to the swingable needle and cam follower means which include a first cam follower and a second cam follower swingably mounted on a guide shaft arranged between the first and the second groups of the pattern cams and the swingable member. Each of the first and second cam followers has one end for engaging a selected one of the first and second groups of the pattern cams and the opposite end for engaging the swingable member. Pattern selecting means are provided, which are operated to move one first cam follower along the guide shaft substantially all through the range defined by the first and the second groups of pattern cams to thereby select one of the first and second groups of pattern cams. The pattern selecting means move the second cam follower in association with the first cam follower within the range defined by the second group of the pattern cams when the first cam follower is moved beyond a predetermined range defined by the first pattern cams, to thereby select two pattern cams, one of which is selected from the first group of the pattern cams and the other of which is selected from the second group of pattern cams. Also means for connecting the first cam follower to the second cam follower are provided, which are operated when the first cam follower is moved beyond the predetermined range defined by the first group of pattern cams.

BRIEF DESCRIPTION OF THE DRAWINGS

FIGS. 1 to 5 show a first embodiment of the invention, and FIGS. 6 to 11 show a second embodiment thereof, wherein FIG. 1 is a perspective view of a mechanism of the first embodiment;

FIG. 2 is a view of engaging cam followers;

FIG. 3 is a side view of the arrangement of FIG. 2;

FIG. 4 is a side view of engaging cam followers:

FIGS. 5(1) to 5(4) are views showing loci of pattern stitchings;

FIG. 6 is a perspective view of a mechanism of the second embodiment;

FIG. 7 is a view of engaging cam followers;

FIG. 8 is a side view of the arrangement of FIG. 7;

FIGS. 9 and 10 are views of an elongator in two different positions; and FIGS. 11(1) to 11(4) are views showing loci of pattern stitchings.

DETAILED DESCRIPTION OF THE PREFERRED EMBODIMENTS OF THE INVENTION

An explanation will be made in detail of the first embodiment of the invention with reference to FIGS. 1 to 5.

Figure 1:
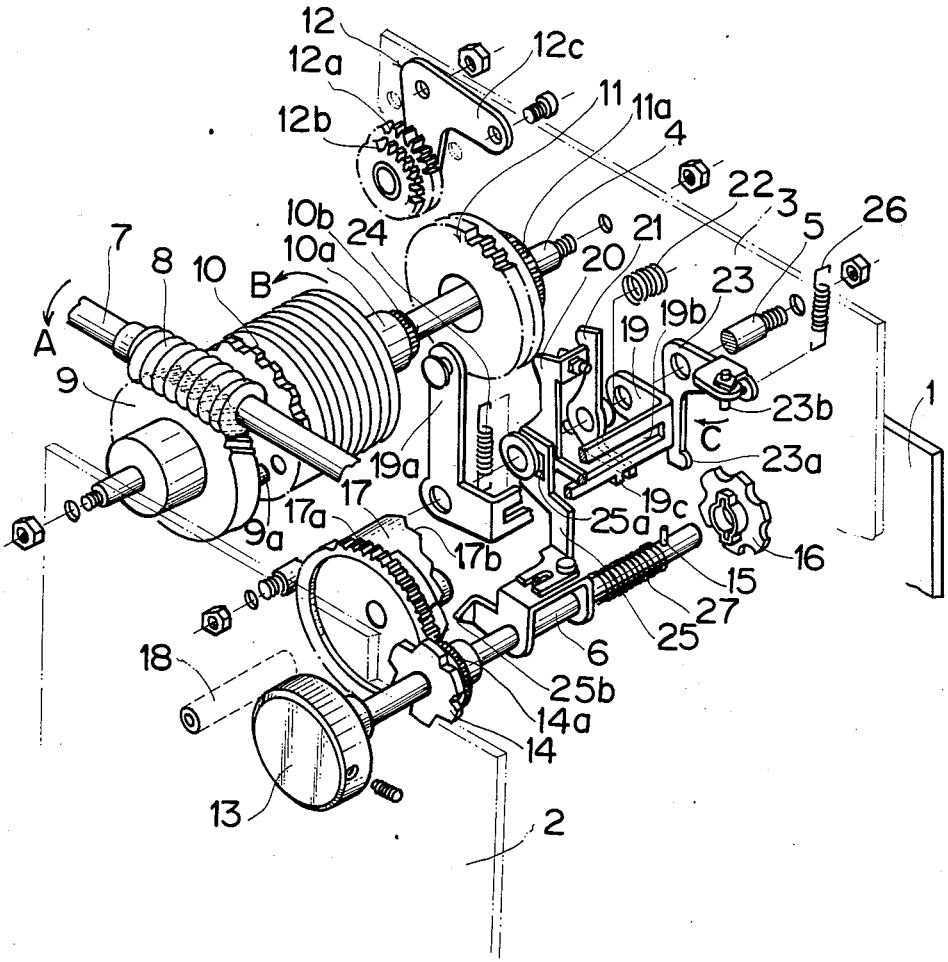
Figure 4:
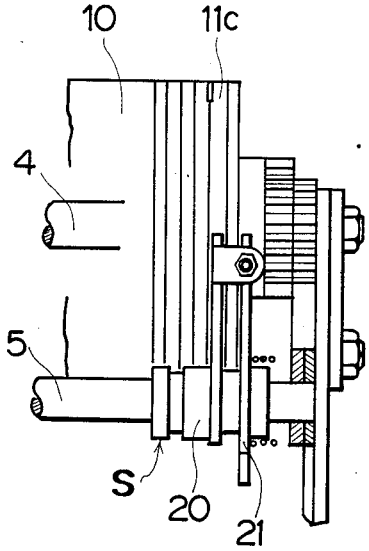

In FIG. 1, the reference numeral 1 designates a machine frame of a sewing machine, and 2 and 3 show bed frames of a mechanism, installed in parallel fixedly with respect to the inner side of the machine frame 1. Numerals 4 and 5 are shafts fixed in parallel to the machine frame, and 6 is a selecting shaft rotatably supported to the bed frame 2. The numeral 7 is a drive shaft rotatably supported in the machine frame 1, on which a worm 8 is secured which is in mesh with a worm gear 9 which is rotatably mounted on the fixed shaft 4. In FIG. 4 a conventional connecting rod, needle bar, and needle are graphically illustrated and collectively designated as **7*a*. The numeral 10 designates a first group of pattern cams which are rotatably mounted on the fixed shaft 4 and to which rotation is transmitted via a pin 9*a* of the worm gear 9. Cams 10 are rotated at speed reduction ratio of 1/18 by means of the drive shaft 7. The first pattern cam group 10 is provided with a mounted on its boss 10*a* second group 11** of pattern cams of 1/36 reduction ratio.

The numeral 12 is a transmission gear provided on the bed frame 3, which rotatably supports a large gear 12*a* and a small gear 12*b* integral therewith by means of an attaching part 12*c*. The large gear 12*a* engages a gear 10*b* of the first pattern cam group 10, and the small gear 12*b* engages a gear 11*a* of the second pattern cam group 11, so that the rotation of the first pattern cam group is transmitted to the second pattern cam group 11 at more speed reduction.

The numeral 13 is a pattern selection part secured to the selecting shaft 6 which is fixed with a feed releasing cam 14 having a gear 14*a*, and a follower releasing cam 16 to which rotation is transmitted by means of a pin 15 positioned at the end of the shaft 6.

The numeral 17 is a cam for selecting a pattern cam. Cam 17 is rotatable on a shaft 18 secured to the bed frame 2, and its gear 17*a* is in mesh with the gear 14*a* of the feed releasing cam 14.

The shaft 5 is furnished with an amplitude arm 19, a 1st follower 20, a 2nd follower 21, and an amplitude releasing arm 23. A groove 19*b* of the amplitude arm 19 engages a projection 20*b* of the 1st follower 20 so as to transmit the movement of the 1st follower 20 engaging the 1st pattern cam group 10 and the 2nd pattern cam group 11 to the amplitude arm 19, and an end portion 19*a* of the amplitude arm 19 engages an amplitude rod (not shown) to be connected with a needle bar supporter (not shown).

The 2nd follower 21 is axially restrained by a follower spring 22 and a projection 19*c* defined in the amplitude arm 19, and is positioned by a boss end 20*a* of the 1st follower 20. With respect to rotation, this member is biased counterclockwise by a spring 24 and follows the 2nd pattern cam 11.

The numeral 25 designates an amplitude pawl sliding plate which is pivoted rotatably on the selection shaft 6, and is biased by a spring 27, so that a pawl 25*b* is in mesh with the cam 17*b* of the selection cam 17, and a fork 25*a* is engaged with a groove of a boss of the 1st follower 20, whereby the positioning of the 1st follower 20 is controlled by the selection cam 17. The amplitude releasing arm 23 is biased counterclockwise by a spring 26 and the pawl 23*a* thereof is engaged with the follower releasing cam 16.

In operation, drive shaft 7 is rotated in the direction of arrow A in FIG. 1, and the 1st pattern cam group 10 is rotated in the direction of arrow B at speed reduction ratio of 1/18 via worm 8 and worm gear 9. The 1st follower 20 is positioned with respect to the 1st pattern cam 10 in a manner as follows.

When the selection dial 13 mounted on the selection shaft 6 is rotated, the follower releasing cam 16 mounted on the selection shaft 6 is rotated. When the amplitude releasing arm 23 engaging the cam 16 is thereby rotated in the direction of arrow C, a screw point 23*b* secured at a bent portion of the arm 23 contacts the amplitude arm 19, and rotates it clockwise. The 1st follower 20 engaging an oblong groove 19*b* of the amplitude arm 19 is released from the 1st pattern cam group 10. Similarly, the 2nd follower 21 engaging the lower surface 19*d* (FIG. 3) of the amplitude arm 19 is also released from the engagement with the 2nd pattern cam group 11.

On the other hand, by the rotation of the selecting shaft 6, the feed releasing cam 14 mounted thereon is rotated, and the selecting cam 17 which is in mesh with the gear 14*a* is rotated, and the amplitude pawl sliding plate 25 contacting the cam face 17*b* is axially moved, and the 1st follower 20 is moved by the fork 25*a*.

These serial movements are performed sequentially by the follower releasing cam 16 and the selection cam 17 with releasing of the 1st and 2nd followers. The movement of the 1st follower causes engagement of the 1st and 2nd followers per each of the 1st pattern cams 10 and the 2nd pattern cams 11.

Figure 2:
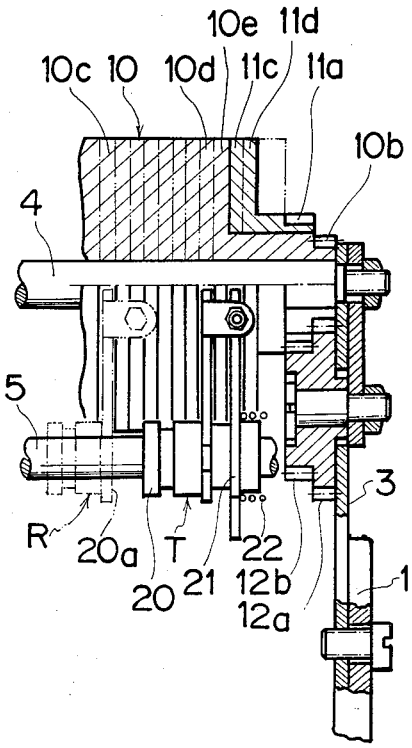
Figure 3:
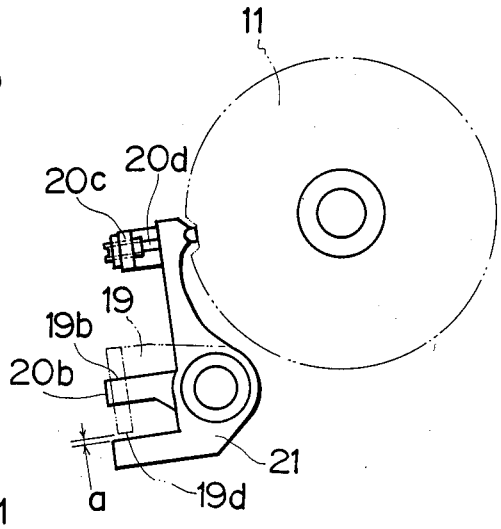

When the selection dial 13 is operated to position the 1st follower 20 at "R" of FIG. 2, this follower 20 is engaged with the pattern cam 10*c* and is driven at the speed reduction ratio of 1/18, and the action of the pattern cam 10*c* is transmitted to an amplitude rod via groove 19*b* of the amplitude arm 19. Thus, an ordinary pattern is formed as seen in FIG. 5 (1). At this time, the 2nd follower 21 which is biased by the spring 22 and positioned by projection 19*c* of the amplitude arm 19, is engaged with the 2nd pattern cam group 11 which is rotated in association with the first group of the pattern cams 10 through a series of gears 10i b, 12*a*, 12*b* and 11*a* at the reduction ratio of 1/36, and a space "$\alpha$" is, as seen in FIG. 3, maintained in relation with the amplitude arm 19, irrespectively of the positions of the 1st and 2nd followers, and therefore the movement of the 2nd follower 21 is not transmitted.

When the 1st follwer 20 is set at a position "S" of FIG. 4 by the operation of the selecting dial 13, the 2nd follower 21 is positioned by the boss end 20*a* of the 1st follower 20 and is out of the engagement with the 2nd pattern cam group 11 but is engaged with the cam 11*c* of the 2nd pattern cam group 11 which is rotated at the reduction of 1/36. Thus, a pattern stitching as shown in FIG. 5 (2) is carried out.

When the 1st follower 20 is set at a position "T" of FIG. 2 by the rotation of the selecting dial 13, the 2nd follower 21 is engaged with cam 10*d* of the 1st pattern cam group 10 and is contacted with the boss of the 1st follower 20 and engaged with the cam 11*c* of the 2nd pattern cam group 11. The 1st follower 20 is secured at its bent portion 20*c* with screw 20*d* which is positioned at a rear side of the 2nd follower 21 as shown in FIG. 3.

The pattern cam 10*d* is rotated at the reduction ratio of 1/18, the stitches formed by this cam are of full zigzag amplitude of 1, 2, 3 . . . 18 as seen in FIG. 5 (3). The pattern cam 11*c* engaging the 2nd follower 21 is rotated at the reduction ratio of 1/36, and stitches formed by this cam are satin patterns (crescent) of 1, 2, 3 . . . 36 as seen in FIG. 5 (2).

L (left) side of the needle dropping is lift sides of the pattern cam 10*d* and the pattern cam 11*c*. R(right) side is recess sides of the pattern cam 10*d* and the pattern cam 11*c*. Since the screw end 20*d* of the 1st follower 20 is positioned at the rear side of the 2nd follower 21 in the position shown with "T" in FIG. 2, the 1st follower 20 is limited in the action toward the recess side of the pattern cam 10*d* by means of the 2nd follower 21 to be engaged with the pattern cam 11*c*. Thus, such composed stitches are formed as shown in FIG. 5 (4), where the amplitude of the stitches formed by the cam of the reduction ratio of 1/36 of FIG. 5 (2) is enlarged. At this point, it is also posible to form another pattern of the reduction ratio of 1/36 by moving the 1st follower 20 so as to cause it to contact the pattern cam 10*e*, and contact the 2nd follower 21 with pattern cam 11*d*. The reason for providing the screw end at the engagement between the 1st follower 20 and the 2nd follower 21 is for adjusting said engagement.

A further explanation will be made to a second embodiment of the invention with reference to FIGS. 6 to 11.

Figure 6:
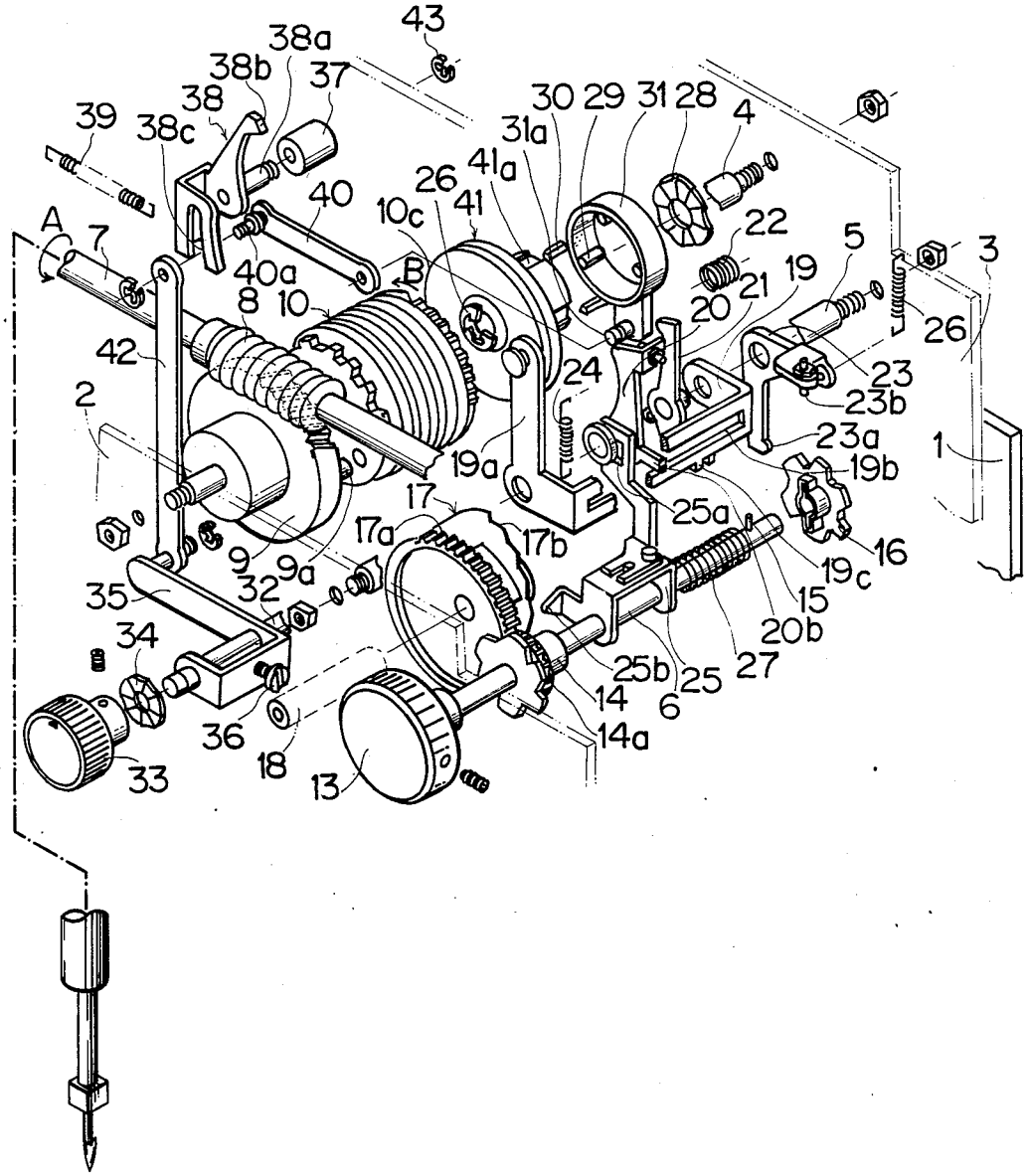

In FIG. 6, the reference numeral 1 designates a machine frame of a sewing machine, and 2 and 3 show bed frames of a mechanism, installed in parallel fixedly with respect to the inner side of the machine frame 1. Numerals 4 and 5 are shafts fixed in parallel to the machine frame, and 6 is a selected shaft rotatably supported to the bed frame 2.

The numeral 7 is a drive shaft rotatably held to the machine frame 1, on which a worm 8 is secured and in mesh with a worm gear 9 which is rotatably mounted on the fixed shaft 4. The numeral 10 designates a first group of pattern cams which are rotatably mounted on the fixed shaft 4 and rotation is transmitted to pattern cams 10 via pin 9*a* of the worm gearm 9, and cam group 10 is rotated at speed reduction ratio of 1/18 by means of the drive shaft 7.

On the shaft 4, a thrust is provided by E ring fitted in a groove thereof and a corrugated washer 28 contacting the bed frame, and a pattern cam 41 is mounted on shaft 4 which may be adjusted at the required reduction ratio. A bush portion 41*a* of the pattern cam 41 is mounted with a clutch roller 29, a clutch spring 30 and a clutch ring 31.

The pattern selecting part, the 1st and 2nd followers are the same as in the 1st embodiment including their engaging and disengaging functions.

A dial shaft 32 is rotatably supported to the bed plates 2, 3, and is provided with an elongator dial 33 connected thereto via the corrugated washer 34. A control arm 35 is secured on shaft 32 by a screw 36. A boss 37 is supported to the bed frame 3, and is thrust-stopped with a shaft 38*a* of an elongator actuation pawl 38 by E ring 43. A pawl 38*b* engages an elongator actuating cam 10*c* provided at one part of the 1st pattern cam group. The actuating pawl 38 has an arc shaped groove 38*c* which provides a play of a pin 40*a* of a rod 40 which is held at its one end by a pin 31*a* provided at the arm of the clutch ring 31, and the pin 40*a* is pivoted with a control rod 42 connected with the control arm 35.

The operation of the present mechanism will be discussed. When the drive shaft 7 is rotated in the direction of arrow A in FIG. 6, and the 1st pattern cam group 10 is rotated in the direction of arrow B at speed reduction ratio of 1/18 via worm 8 and worm gear 9. The 1st follower 20 is positioned with respect to the 1st pattern cam group 10 in a manner as follows.

When the selection dial 13 mounted on the selection shaft 6 is rotated, the follower releasing cam 16 mounted on the selection shaft 6 is also rotated. When the amplitude releasing arm 23 engaging the cam 16 is thereby rotated in the clockwise direction in FIG. 6, a screw point 23*b* secured at the bent portion of the arm 23 contacts the amplitude arm 19, and rotates it clockwise. The 1st follower 20 with projection 20*b* engaging the oblong groove 19*b* of the amplitude arm 19 is released from the 1st pattern cam group 10. Similarly, the 2nd follower 21 engaging the lower surface 19*d* (FIG. 8) of the amplitude arm 19 is also released from the engagement with the 2nd pattern cam group 11.

On the other hand, by the rotation of the selecting shaft 6, the feed releasing cam 14 mounted thereon is rotated, and the selecting cam 17 which is in mesh with the gear 14*a* is rotated, and the amplitude pawl sliding plate 25 contacting the cam face 17*b* is axially moved, and the 1st follower 20 is moved by the fork 25*a*. These serial movements are performed sequentially by the follower releasing cam 16 and the selection cam 17 with releasing of the 1st and 2nd followers. The movement of the 1st follower causes engagement of the 1st and 2nd followers per each group of the 1st pattern cams 10.

Figure 7:
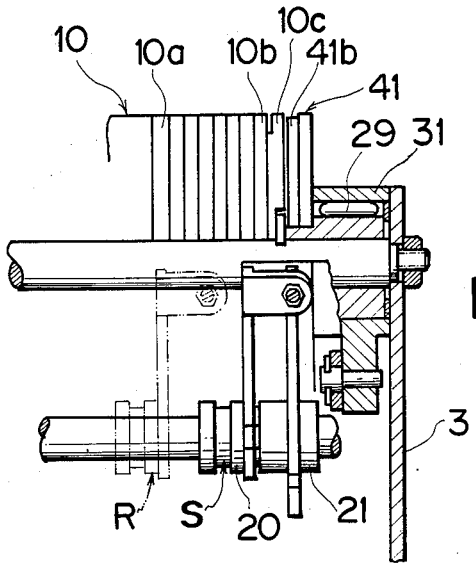

When the selection dial 13 is operated to position the 1st follower 20 at "R" of FIG. 7, this follower 20 is engaged with the pattern cam 10*a* and is driven at the speed reduction ratio of 1/18, and the action of the pattern cam 10*a* is transmitted to an amplitude rod via groove 19*b* of the amplitude arm 19. Thus, an ordinary pattern is formed as seen in FIG. 11 (1). At this time, the 2nd follower 21 which is biased by the spring 22 and is positioned by convex 19*c* of the amplitude arm 19, is engaged with the 2nd pattern cam group 11, but is not in engagement with the amplitude arm 19. Therefore the swinging movement of the second follower 21 is not transmitted to the amplitude arm 19.

Figure 8:
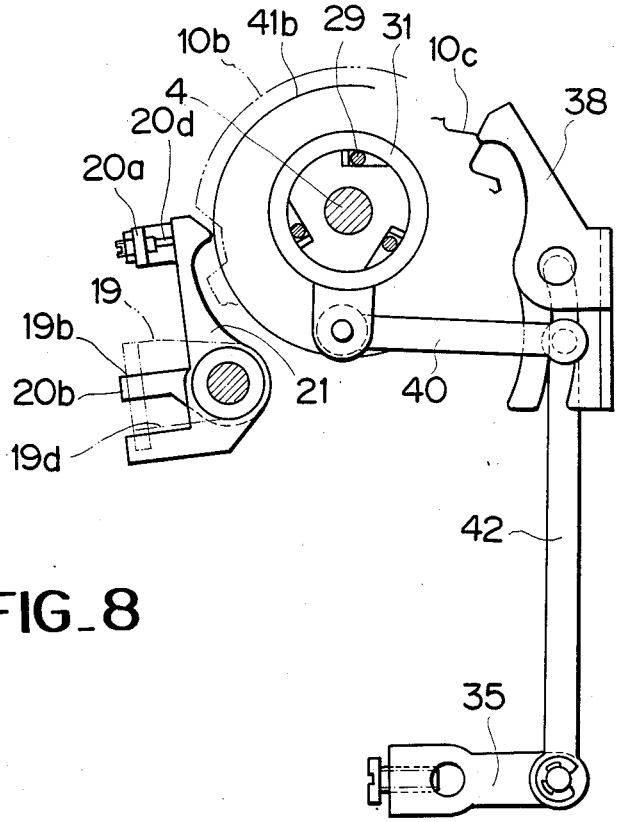

When the 1st follower 20 is set at a position "S" of FIG. 7 by the rotation of the selecting dial 13, in other words, when the follower 20 is engaged with the pattern cam 10*b*, the screw end 20*d* secured on the bent portion 20*a* is positioned at the rear side of the 2nd follower 21 (FIG. 8).

The pattern cam 10*b* is rotated at the reduction ratio of 1/18, and stitches formed by this cam only are of full zigzag amplitudes of 1, 2, 3 . . . 18 as seen in FIG. 11 (1).

The 2nd pattern cam 41*b* linearly increases and decreases the patterns. The follower 21 engages the pattern cam 41*b* as seen in FIG. 8, and the screw end 20*d* provided at the 1st follower 20 contacts the rear side of the 2nd follower 21 so as to limit the movement of the 1st follower 20 toward the recess of the cam.

Figure 9:
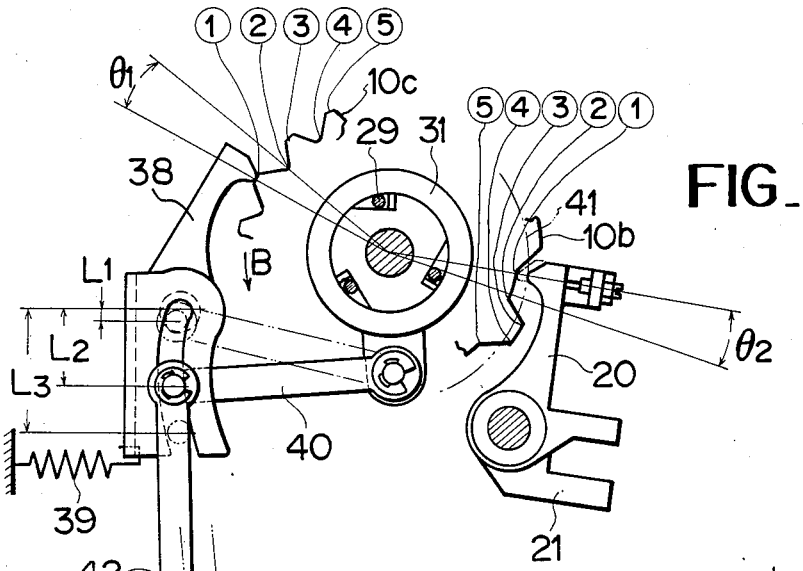

The operation of the pattern cam 41 will be discussed with respect to the driving condition thereof. FIG. 9 illustrates that the elongator actuating pawl 38 engages the lift side of the elongator actuating cam group 10*c* formed in the 1st pattern cam 10. At this time, the follower 20 is ready for engaging the pattern cam 10*b* of the full zigzag amplitude at a starting position ① of an equal diameter part of the recess side of the pattern cam 10*b* shown with a dotted line. However, actually the screw end point 20*d* of the 1st follower 20 contacts, as shown with the solid line, the rear side of the 2nd follower 21 engaging the 2nd pattern cam 41, the movement of the 1st follower 20 is limited by recess of the pattern cam 10*b*.

Figure 10:
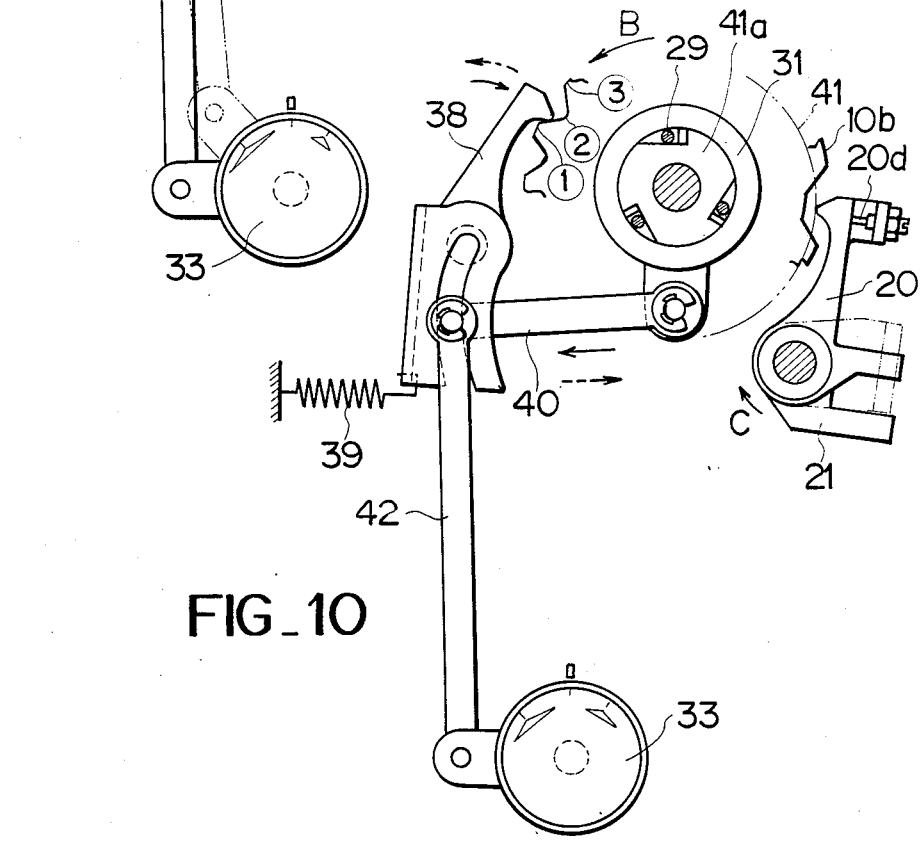

When the drive shaft 7 is rotated and the elongator actuating cam 10*c* is rotated in the direction of arrow B, the elongator pawl 38 moves into the recess ② of the elongator pawl cam 10*c* as seen in FIG. 10, and the clutch ring 31 is pulled in the direction shown with the solid line, i.e., clockwise by the action of the spring 39, and the clutch roller 29 is made idle by the friction of the corrugated washer 28 which contacts the bush portion 41*a* of the pattern cam 41, and the pattern cam 41 remains stopped. At an angle $\theta_1$ between the lift side and recess side of the elongator actuating cam 10*c*, the pattern cam 41 is stopped, and at this duration the follower 20 engaging the pattern cam 10*b* follows in an angle $\theta_2$ of the equal diameter part side of the recess side of the 1st pattern cam 10*b* and is not rotated by the cam. The angle $\theta_1$ of the elongator actuating cam 10*c* and and the angle $\theta_2$ of the 1st pattern cam 10*b* are determined to be equal and the same phase.

When the elongator actuating pawl 38 goes from the recess ② of the elongator actuating cam 10*c* to the lift ③, the clutch ring 31 is rotated against the spring 39 toward the direction shown with the dotted line, and the clutch roller 29 moves between the clutch ring 31 and the bush portion 41*a* of the pattern cam 41, and the actuation of the elongator pawl 38 is caused to rotate the pattern cam 41 counterclockwise and rotate the follower 21 engaging the pattern cam 41. At this time, the 1st follower 20 moves from the recess side ② to the lift side ③ of the pattern cam 10*b* and rotates in the direction of arrow C. The elongator actuating cam 10*c* and the pattern cam 10*b* are in advance set such that the rotation phase of the 2nd pattern cam group 11 and the rotation phase of the 1st follower 20 are synchronized.

When the elongator actuating pawl 38 advances from the lift ③ of the elongator actuating cam 10*c* to the recess ④, the clutch roller 29 is made idle as said above, and the pattern cam 41 is stopped, and the 1st follower 20 progresses from the equal diameter part ③ of the lift side of the part ④, and the 1st follower 20 is not rotated.

Thus, the pattern cam 41 is rotated intermittently via the clutch ring 31 by the actions of the elongator cam 10*c* and the elongator actuating pawl 38.

The follower 21 follows the pattern cam 41*b*, but only when the 1st follower 20 is rotated.

With respect to the generation of the pattern, the screw end point 20*d* of the 1st follower 20 is positioned at the rear side of the 2nd followr 21, and the 1st follower is limited in movement to the recess sie of the patterns (FIG. 11 (1)) of the pattern cam 10*b* by means of the 2nd follower 21 which follows the pattern cam 41*b*, and the stitches are formed as shown in FIG. 11 (3).

A still further reference will be made to the control of the elongator. The condition shown with the solid line in FIG. 9 is "Middle" of the control range of "Large", "Middle" and "Small" of the elongator dial 33. The distance between the center of pin 40*a* of the rod 40 and the center of actuation of the elongator actuating pawl 38 is $L_2$. When the elongator dial 33 is rotated clockwise to "Large" as shown with the dotted line, the above mentioned distance is shortened to $L_1$.

In such a manner, the intermittent rotation angle of the pattern cam 41 is made small, and the extent of the linear increase and decrease by the pattern cam 41 is made moderate, so that the composed pattern is made large in size as shown in FIG. 11 (4).

Reversely, when the elongator dial 33 is rotated counterclockwise to "Small", the distance is made large as $L_3$, so that the intermittent rotation angle of the pattern cam 41 is made large and the extent of the linear increase and decrease by the pattern cam 41*b* is made accute, and the composed pattern is small in size as shown in FIG. 11 (2).

What is claimed is:

1. A zigzag sewing machine including a drive shaft rotated to vertically reciprocate, pattern cams, and a needle which is operatively connected to the pattern cams and is swingable laterally of a fabric feeding direction under the control of the pattern cams, the sewing machine further comprising a cam shaft; said pattern cams including a first group of pattern cams rotatably mounted on the cam shaft and operatively connected to said drive shaft to be rotated thereby at a first predetermined reduced speed, and a second group of pattern cams rotatably mounted on said cam shaft and operatively connected to said first group of the pattern cams to be rotated thereby at a second predetermined reduced speed; transmission means including a swingable member (19) positioned between said first and second group of said pattern cams and said swingable needle and operatively connected to said needle; cam follower means including a first cam follower (20), a guide shaft (5), and a second cam follower (21) swingably mounted on said guide shaft, which is arranged between said first and second group of the pattern cams and said swingable member (19), each of said first and second cam followers having one end for engaging a selected one of said first and second group of pattern cams and an opposite end for engaging said swingable member; pattern selecting means operated to move said first cam follower along said guide shaft substantially all through a range defined by said first and second group of pattern cams to thereby select one of said first and second groups of pattern cams, said pattern selecting means moving said second cam follower in association with said first cam follower within a range defined by said second group of pattern cams when said first cam follower is moved beyond a predetermined range defined by said first group of pattern cams, to thereby select two pattern cams, one of which is selected from said first group of pattern cams and the other of which is selected from said second group of pattern cams; and means for connecting said first cam follower to said second cam follower when said first cam follower is moved beyond said predetermined range defined by said first group of the pattern cams.

2. The sewing machine as defined in claim 1, wherein said connecting means is mounted on said first cam follower including an element (20*d*) for engaging said second cam follower to limit a swinging movement of said first cam follower toward a selected cam.

3. The sewing machine as defined in claim 2, wherein said engaging element (20*d*) is adjustable with respect to said second cam follower.

4. A sewing machine including a drive shaft rotated to vertically reciprocate, pattern cams, and a needle which is operatively connected to the pattern cams and is swingable laterally of a fabric feeding direction under the control of the pattern cams, said sewing machine further comprising a cam shaft; said pattern cams including a first group of pattern cams rotatably mounted on said cam shaft and operatively connected to said drive shaft to be rotated thereby at a predetermined reduced speed, and a second group of pattern cams rotatably mounted on said cam shaft; transmission means including a swingable member (19) positioned between said first and second group of pattern cams and said swingable needle and operatively connected to said needle; cam follower means including a guide shaft (5), a first cam follower, (20) and a second cam follower (21) swingably mounted on said guide shaft (5) which is arranged between said first and second group of pattern cams and said swingable member (19), each of said first and second cam followers having one end for engaging a selected one of said first and second group of pattern cams and an opposite end for engaging said swingable member; pattern selecting means operated to move said first cam follower along said guide shaft substantially all through a range defined by said first and second group of pattern cams to thereby select one of said first and second group of pattern cams; said pattern selecting means moving said second cam follower in association with said first cam follower within a range defined by said second group of pattern cams when said first cam follower is moved beyond a predetermined range defined by said first group of pattern cams, to thereby select two pattern cams, one of which is selected from said first group of pattern cams and the other of which is selected from said second group of pattern cams; means for connecting said first cam follower to said second cam follower when said first cam follower is moved beyond said predetermined range defined by said first group of pattern cams; and means for rotating stepwise said second group of pattern cams, said rotating means including a fixed shaft, a control cam (10*c*) mounted on said cam shaft and rotated with said first group of pattern cams (10*c*), a third cam follower (38) swingable on said first shaft having one end, said third cam follower having an opposite extension (38*c*), said one end engaging said third cam follower, and a clutch operatively connected to said second group of pattern cams and also operatively connected to said opposite extension of said third cam follower, said clutch being reciprocatingly driven in association with a swinging movement of said third cam follower under the control of said control cam, and transmitting the movement of said third follower in one direction to said second group of pattern cams.

5. The sewing machine as defined in claim 4, further comprising means for adjusting a reciprocating movement of said clutch, said adjusting means including a transmission rod (40) having one end operatively connected to said opposite extension (38*c*) of said third cam follower and an opposite end connected to said clutch, and a manually operated dial (33) operatively connected to said one end of said transmission rod, said dial being operated to change a position of said one end of said transmission rod with respect to said opposite extension of said third cam follower.

* * * * *